US008857111B2

(12) United States Patent
Wang et al.

(10) Patent No.: US 8,857,111 B2
(45) Date of Patent: Oct. 14, 2014

(54) COMPOSITE DAMPER

(71) Applicants: National Cheng Kung University, Tainan (TW); Tongji University, Shanghai (CN)

(72) Inventors: Yun-Che Wang, Tainan (TW); Bin Zhao, Shanghai (CN); Hai-Jie Ge, Shanghai (CN); Chih-Chin Ko, Kaohsiung (TW)

(73) Assignees: National Cheng Kung University, Tainan (TW); Tongji University, Shanghai (CN)

( * ) Notice: Subject to any disclaimer, the term of this patent is extended or adjusted under 35 U.S.C. 154(b) by 0 days.

(21) Appl. No.: 13/930,783

(22) Filed: Jun. 28, 2013

(65) Prior Publication Data

US 2014/0000185 A1 Jan. 2, 2014

(30) Foreign Application Priority Data

Jun. 29, 2012 (TW) ..... 101123525 A

(51) Int. Cl.
*E04B 1/98* (2006.01)
*E04H 9/02* (2006.01)

(52) U.S. Cl.
CPC ..... *E04H 9/027* (2013.01); *E04B 1/985* (2013.01)
USPC ..... 52/167.8; 52/167.1; 267/140.13

(58) Field of Classification Search
CPC ..... E02D 27/54; E02D 27/44
USPC ..... 52/167.1–167.9; 267/134, 135, 141.1, 267/140.11, 140.12, 140.13, 140.3, 140.4, 267/141; 248/615, 627, 634, 635, 632
See application file for complete search history.

(56) References Cited

U.S. PATENT DOCUMENTS 4,976,412 A * 12/1990 Simon et al. ..... 248/634
5,946,866 A * 9/1999 Weglewski et al. ..... 52/167.1
6,141,919 A * 11/2000 Robinson ..... 52/167.7

* cited by examiner

*Primary Examiner* — Jeanette E Chapman
*Assistant Examiner* — Daniel Kenny
(74) *Attorney, Agent, or Firm* — Ming Chow; Sinorica, LLC

(57) ABSTRACT

A composite damper includes a first connector, a second connector and at least a dampening device. The first connector and the second connector are relative movable to each other, and the at least one dampening device is received between the first connector and the second connector. The dampening device comprises at least a rigid member and at least a dampening member, wherein the rigid member has the properties of high stiffness and low damping, while the dampening member has the properties of low stiffness and high damping. With such design, the composite damper could absorb vibrations during earthquakes.

15 Claims, 8 Drawing Sheets

COMPOSITE DAMPER

The current application claims a foreign priority to the patent application of Taiwan No. 101123525 filed on Jun. 29, 2012.

BACKGROUND OF THE INVENTION

1. Technical Field

The present invention relates to a support system for a building, bridge or structure. Particularly, the invention relates to a composite damper, which may absorb energies from earthquakes or vibrations.

2. Description of Related Art

Energy absorption structure is widely used in many buildings, and is set in specified locations, like junctions of beams and columns, to absorb vertical and horizontal forces from the weight of the building itself or from earthquakes or vibrations.

Dampers are the commonest devices used in the energy absorption system, and they may reduce the amplitude of vibration. For the dampers designed for earthquake, they have to sustain various stresses, such as normal stress, shear stress, and torsion stress, etc., but the conventional dampers are mostly emphasized absorption of shear stress only, and while dealing with more complicated situation, the efficiency of energy absorption may decline, and the dampers may become unstable. Therefore, the conventional dampers only have limited effect for earthquake protection.

BRIEF SUMMARY OF THE INVENTION

In view of the above, the primary objective of the present invention is to provide a composite damper, which may dampen all-directional stresses of an earthquake or vibration.

The present invention provides a composite damper, comprising a first connector, a second connector, and at least a dampening device. The first connector has at least a first arm. The second connector has at least a second arm, wherein the first connector and the second connector are relatively movable to each other. At least one dampening device is received between the first connector and the second connector, wherein the dampening device has at least a rigid member and a dampening member coupled to the rigid member, and the rigid member has at least a first end fixed to the first arm of the first connector and at least a second end fixed to the second arm of the second connector.

With such design, the composite damper could reduce the amplitude of vibration from all kinds of stresses resulted from all directions during earthquakes or vibrations.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
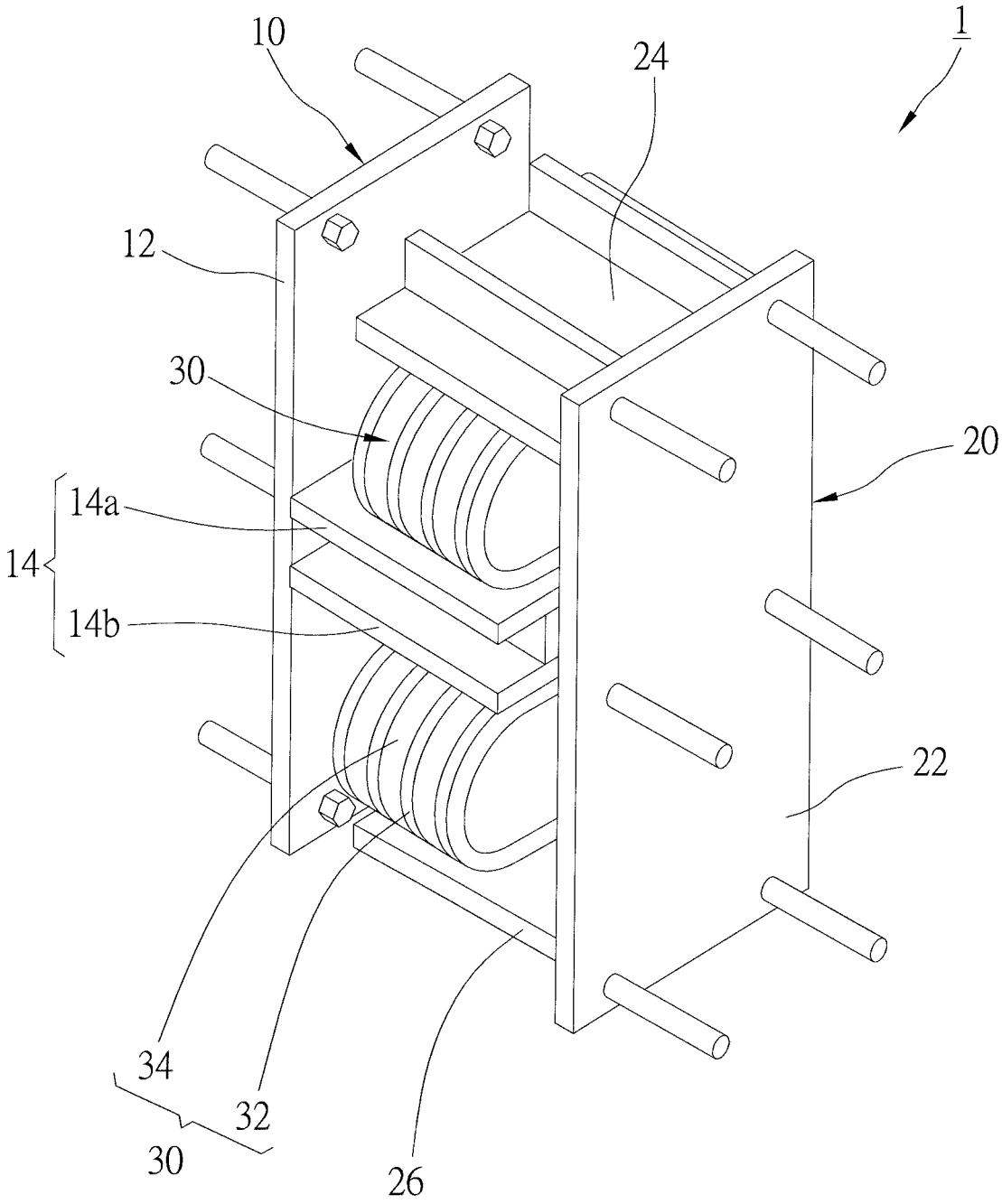
FIG. 1 is a perspective view of a first preferred embodiment of the present invention.
Figure 2:
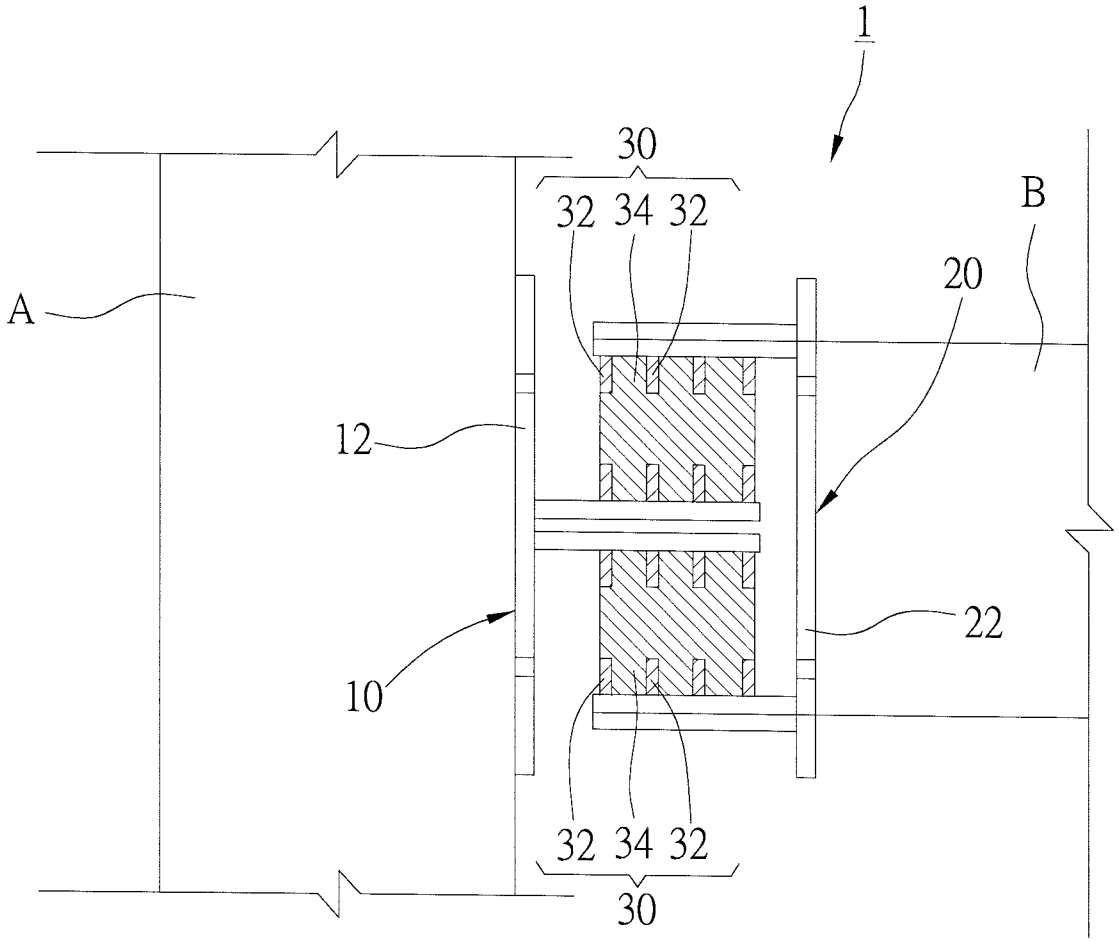
FIG. 2 is a sketch diagram, showing the composite damper of the first preferred embodiment of the present invention installed in the building.

As shown in FIG. 1 and FIG. 2, a composite damper 1 of the first preferred embodiment of the present invention is applied to be installed in a building, bridge or structure, and more specifically at a junction between a first structure A and a second structure B. The aforementioned structures may be beams or columns made of Steel, Steel Reinforced Concrete (SRC) or Reinforced Concrete (RC). In the following paragraph, we suppose that the first structure A is a pillar, and the second structure B is a beam.

The composite damper 1 of the first preferred embodiment of the present invention has a first connector 10, a second connector 20, and two dampening devices 30.

The first connector 10 has a first base 12 and a first arm 14. The first base 12 is fixed to the pillar A. The first arm 14 has two parallel steel plates 14*a*, 14*b*. The steel plates 14*a* and 14*b* are connected perpendicularly to the first base 12 with their ends. The entire first connector 10 is preferable to be made of steel.

The second connector 20 has a second base 22 and two second arms 24, 26. The second base 22 is fixed to the beam B. The second arms 24, 26 are parallel to the first arm 14, and are connected perpendicularly to the second base 22 with their ends. The entire second connector 20 is preferable to be made of steel too. The first connector 10 and the second connector 20 are relative movable to each other for dampening vibrations during earthquakes.

The two dampening devices 30 are located between the first base 12 and the second base 22, and one is located between the steel plate 14*a* and the second arm 24, and the other is located between the steel plate 14*b* and the second arm 26. Each dampening device 30 has a plurality of rigid members 32 and a dampening member 34.

Figure 3:
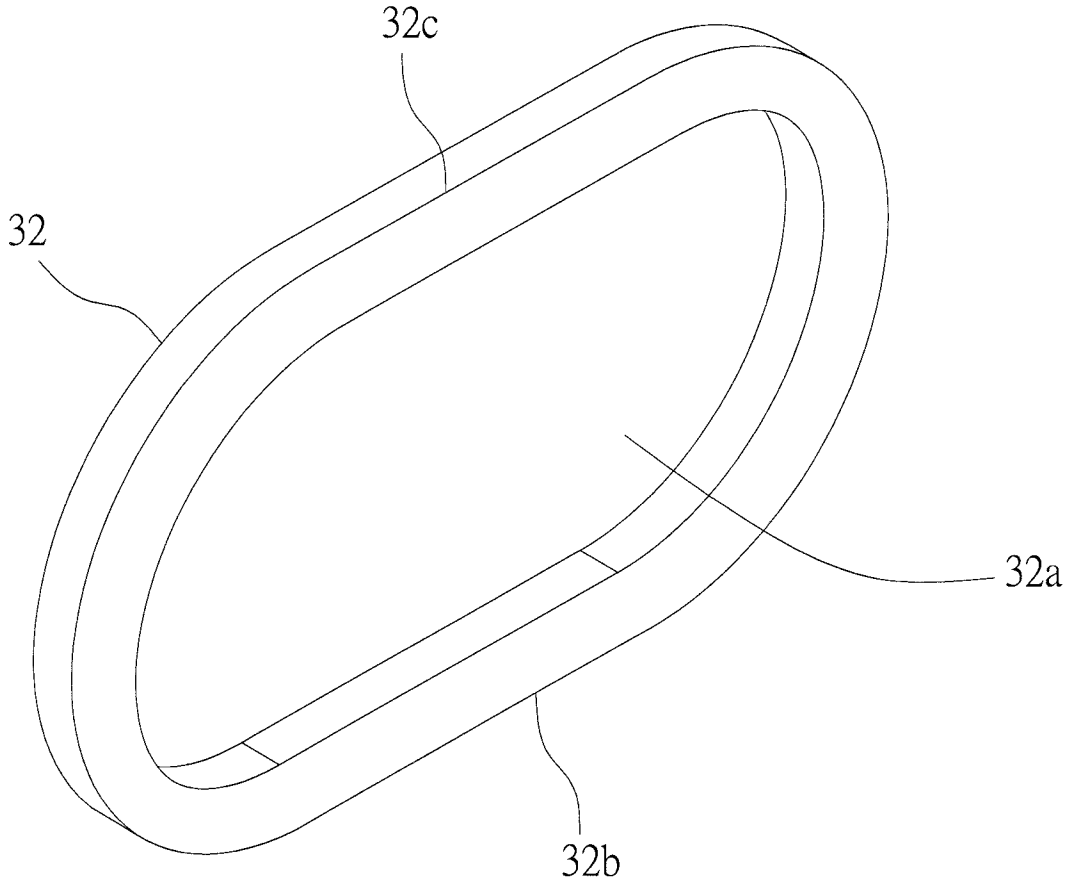
FIG. 3 is a perspective view of the rigid member of the first preferred embodiment of the present invention.

As shown in FIG. 3, each rigid member 32 is an elliptical plate with a hollow portion 32*a* therein, and is preferable to be made of materials with a viscoelasticity storage modulus between 25 GPa and 250 GPa, such as low yield strength metals, i.e. mild steel, aluminum, titanium, or titanium alloy, to let the rigid member 32 have good performance of plastic deformation and energy dissipation. In the present invention, the rigid member 32 is made of low yield strength steel.

Each elliptical rigid member 32 has a first end 32*b* and a second end 32*c* along a short axis of the elliptical rigid member 32. The rigid members 32 are arranged in parallel, and the first ends 32*b* thereof are fixed to the steel plate 14*a* or 14*b* by welding, and the second ends 32*b* thereof are fixed to the second arm 24*a* or 26 by welding too.

The dampening member 34 is made of rubber, macromolecular material, or metal alloys with high damping properties, which has a viscoelasticity storage modulus between 1 MPa and 10 MPa, as well as a loss modulus between 0.1 MPa and 1 GPa. The dampening member 34 is a block with an elliptical cross section, and has slots on a circumference thereof to engage the rigid members 32. In an embodiment, the rigid members 32 are mounted in a die filled with rubber. The rubber is filled in the die in molten state to be coupled to the rigid members 32, and after getting solidified, the solidified rubber becomes the dampening member 34.

In the present embodiment, the rigid members 32 of the dampening device 30 have both properties of high stiffness and low damping, and the dampening member 34 has both properties of low stiffness and high damping. Since the rigid members 32 and the dampening member 34 are set in an alternate arrangement, it provides the composite damper 1 with high stiffness and high damping, which is able to absorb the all-directional and complex vibrations from earthquakes or other causes.

Although the rubber or the macromolecular material of the dampening member 34 has the problem of ageing deterioration, the low yield strength metallic plates of the rigid members 32 will work still, so that the composite damper 1 still may absorb the vibrations of earthquakes even if the dampening member 34 is deteriorated. Furthermore, the dampening devices 30 are replaceable and fixable, so the composite damper 1 could be maintained to keep in normal function.

Figure 4:
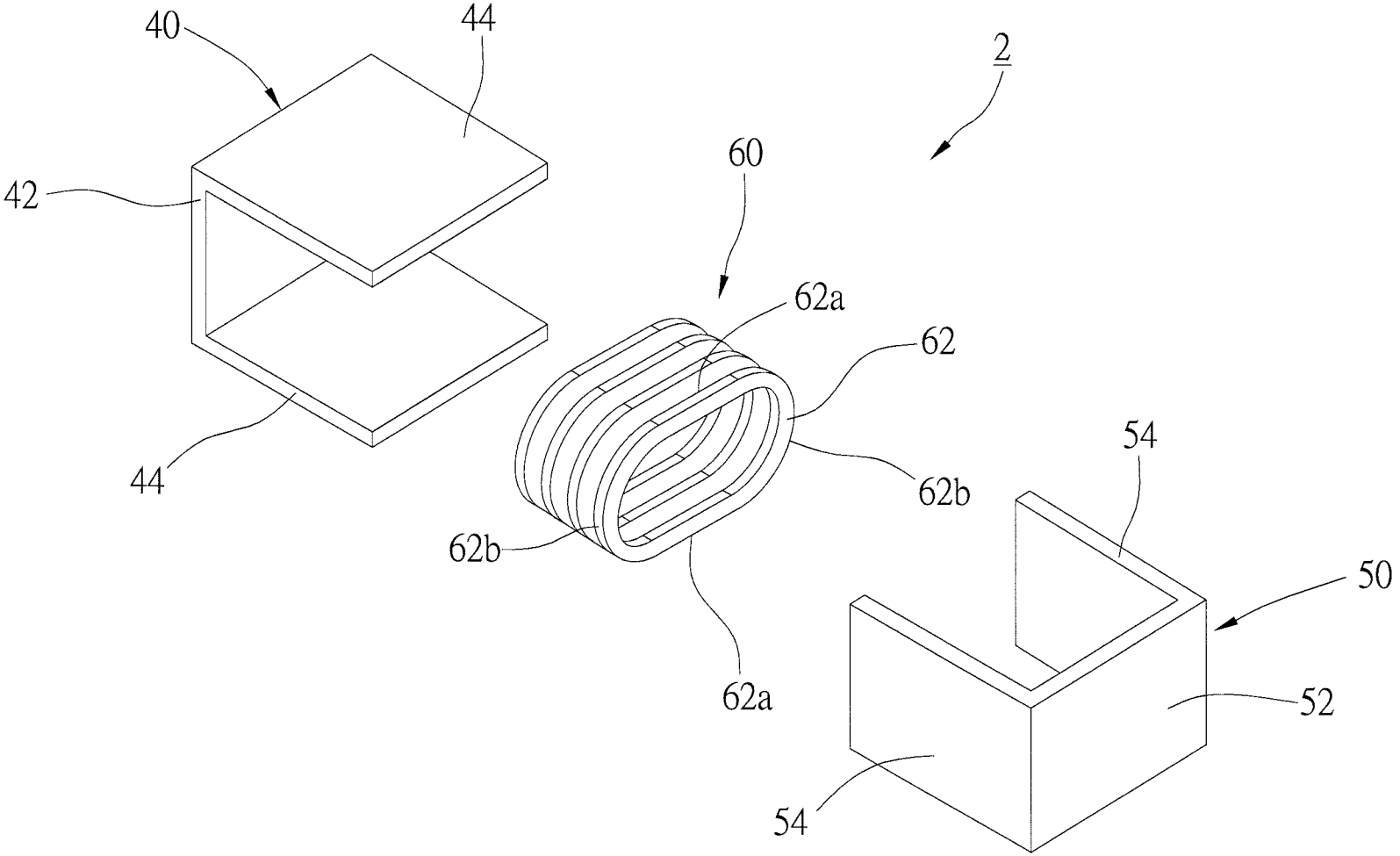
FIG. 4 is a perspective view of a second preferred embodiment of the present invention.

FIG. 4 shows a composite damper 2 of the second preferred embodiment of the present invention, which is similar to the first embodiment, except that:

A first connector 40 has a first base 42 and two first arms 44. The first arms 44 are horizontal and connected to a top end and a bottom end of the first base 42. A second connector 50 has a second base 52 and two second arms 44. The second arms 54 are vertical and connected to a left end and a right end of the second base 52. A dampening device 60 has a plurality of rigid members 62 and a dampening member between the rigid members 62. Each rigid member 62 has two first ends 62*a* and two second ends 62*b*, where in the first ends 62*a* are at a top and a bottom, and the second end 62*b* are at a right side and a left side.

The second connector 50 engages the first connector 40 to form a hollow box, and the dampening device 60 is received in the box. The first ends 62*a* of the rigid member 62 fixed to the first arms 44 of the first connector 40, and the second ends 62*b* fixed to the second arms 54 of the second connector 50. The dampening device 60 of the second preferred embodiment basically is the same as the dampening device 30 of the first preferred embodiment, except that the dampening device 60 is hollow. The composite damper 2 of the second preferred embodiment has the same function for absorbing vibrations.

Figure 5:
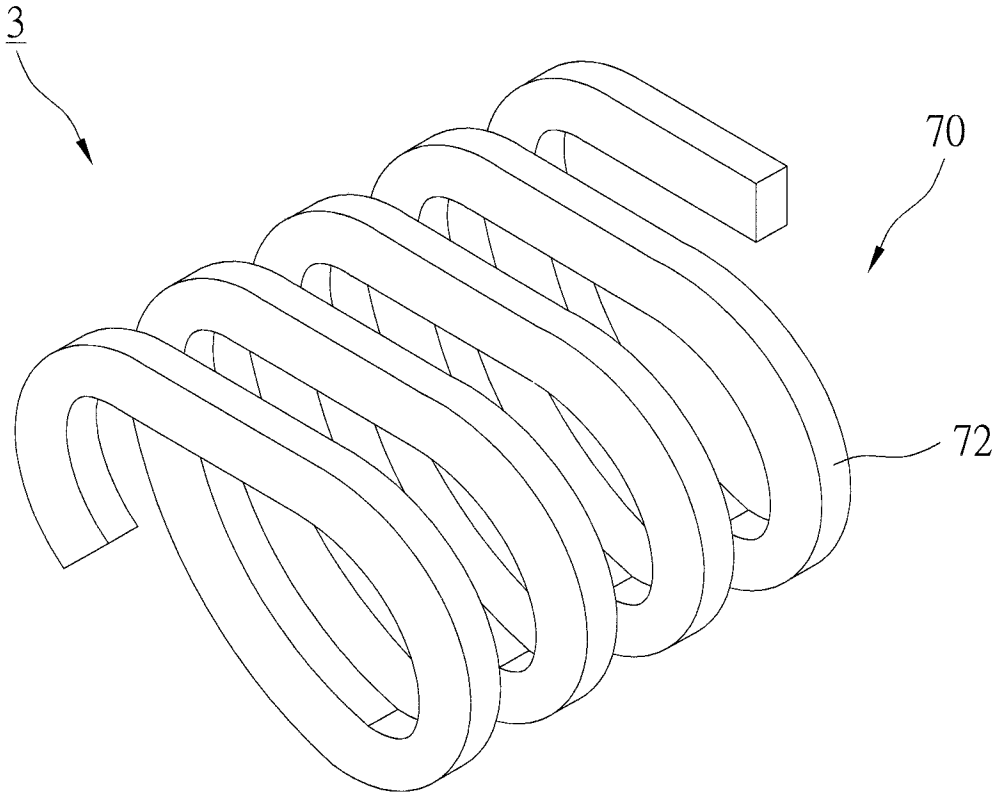
FIG. 5 is a perspective view of the rigid member of a third preferred embodiment of the present invention.

FIG. 5 shows a rigid member 72 of a dampening device 70 of a composite damper 3 of the third preferred embodiment, which has roughly the same structure with the prior embodiments, where the difference is:

The rigid member 72 is a spiral spring, and is made of a material with a viscoelasticity storage modulus between 25 GPa and 250 GPa. The dampening member is coupled to spiral rigid member 72 in the same way as the aforementioned embodiments, and the dampening device 70 is fixed to the first connector and the second connector respectively in the same way.

Figure 6:
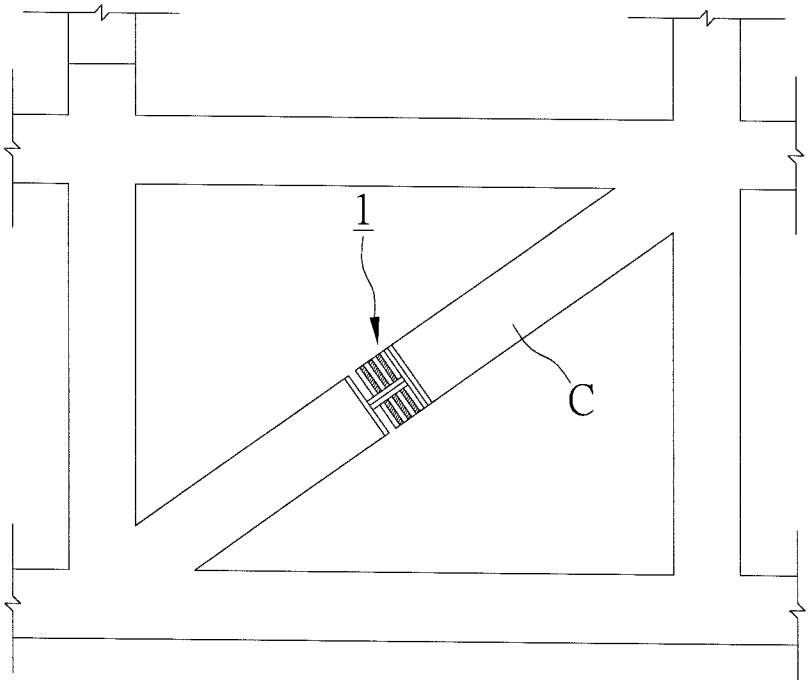
FIG. 6 is a sketch diagram, showing the damper of the present invention installed for buckling brace.
Figure 7:
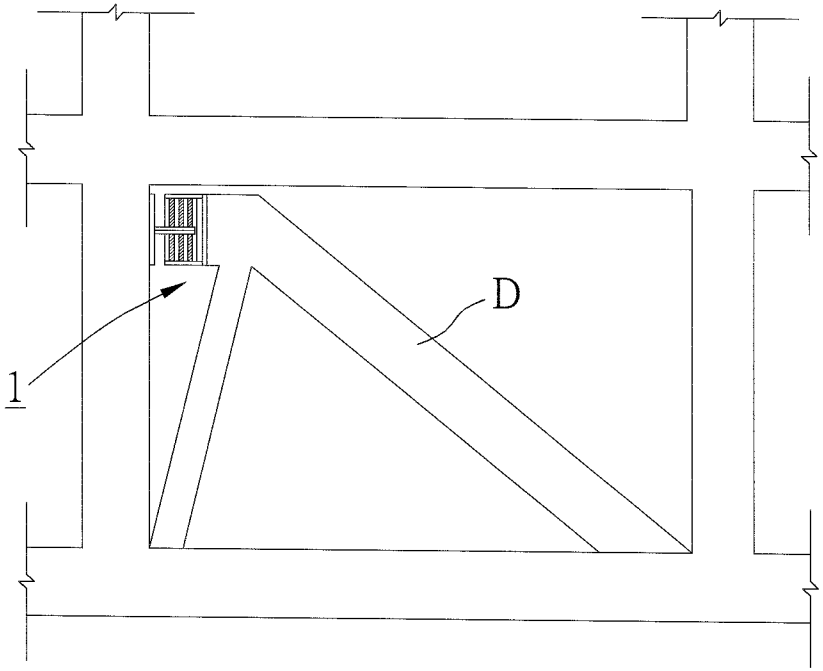
FIG. 7 is a sketch diagram, showing the damper of the present invention installed for another type of buckling brace.
Figure 8:
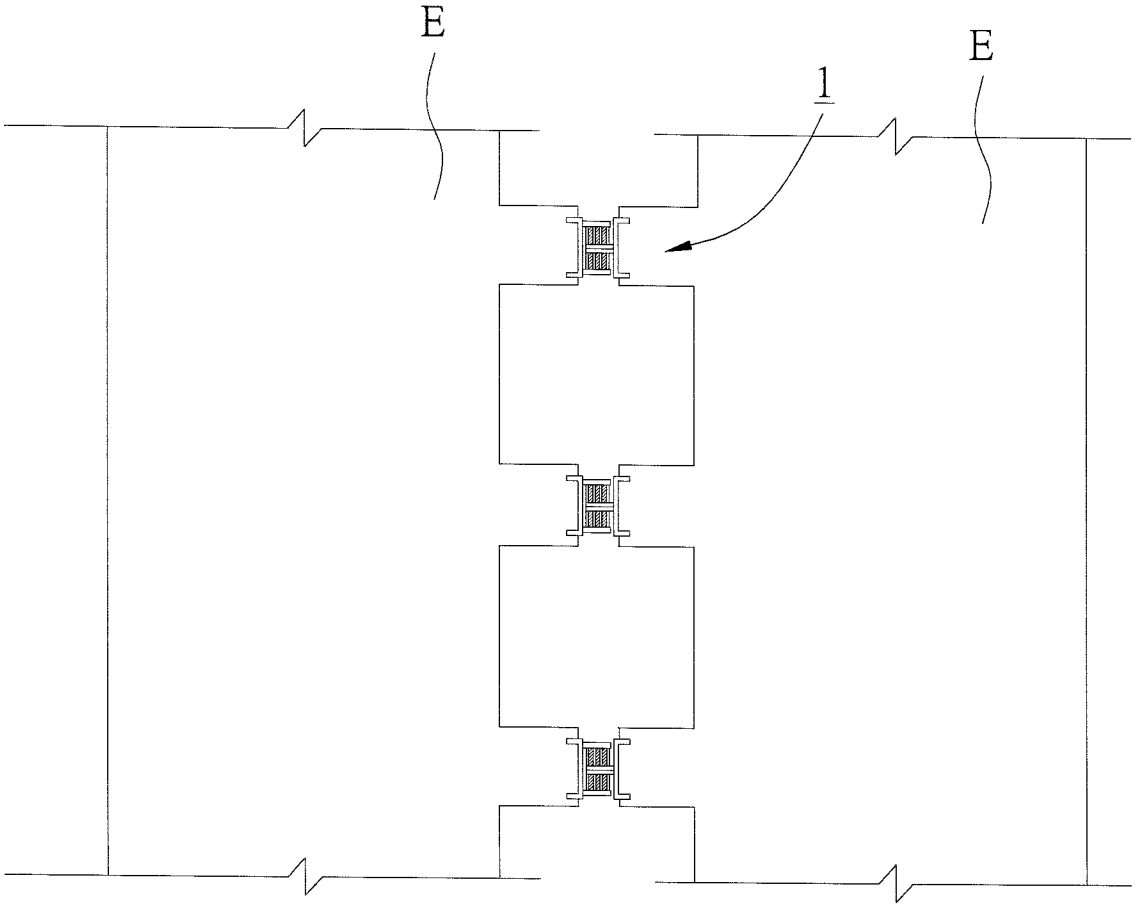
FIG. 8 is a sketch diagram, showing the damper of the present invention installed in the shear stress wall structure.

The composite damper could not merely be installed in vertical pillar and transverse beam, but also suitable for a buckling brace C as shown in FIG. 6 or a brace D as shown in FIG. 7, and it may be installed in a shear stress wall structure E as shown in FIG. 8 too. The composite damper 1 of the first preferred embodiment is shown in FIG. 6 to FIG. 8 as an example. Needless to say that the other two composite dampers 2 and 3 as described above may be also applied to be installed in the structures as shown in FIG. 6 to FIG. 8.

It must be pointed out that the embodiments described above are only some preferred embodiments of the present invention. All equivalent structures which employ the concepts disclosed in this specification and the appended claims should fall within the scope of the present invention.

What is claimed is:

1. A composite damper, comprising:

a first connector having at least a first arm;

a second connector having at least a second arm, wherein the first connector and the second connector are relative movable to each other; and at least a dampening device received between the first connector and the second connector, wherein the dampening device has at least a rigid member and a dampening member coupled to the rigid member, and the rigid member has at least a first end fixed to the first arm of the first connector and at least a second end fixed to the second arm of the second connector;

the rigid member of the dampening device has a hollow portion; and the dampening member is received in the hollow portion of the rigid member.

2. The composite damper of claim 1, wherein the first connector further has a first base; the first arm is perpendicularly connected to the first base; the second connector further has a second base; and the second arm is perpendicularly connected to the second base.

3. The composite damper of claim 2, wherein the second connector has two of the second arms; the first arm of the first connector is between the second arms of the second connector; the first arm is parallel to the second arms; two of the dampening device are received in spaces between the first arm and the second arms respectively.

4. The composite damper of claim 2, wherein the first connector has two of the first arms; the second connector has two of the second arm; the first arms are perpendicular to the second arms; the rigid member of the dampening device is fixed to the first arms and the second arms respectively.

5. The composite damper of claim 1, wherein the rigid member is made of a material with a viscoelasticity storage modulus between 25 GPa and 250 GPa.

6. The composite damper of claim 1, wherein the rigid member of the dampening device is made of low yield strength metal.

7. The composite damper of claim 6, wherein the low yield strength metal is selected from the group consisting of mild steel, aluminum, titanium, and titanium alloy.

8. The composite damper of claim 1, wherein the rigid member of the dampening device is spiral, and the dampening member is rubber coupled to the rigid member.

9. The composite damper of claim 8, wherein the dampening member is rubber, macromolecular material, or metal alloys with high damping properties.

10. The composite damper of claim 8, wherein the dampening member has a viscoelasticity storage modulus between 1 MPa and 10 GPa.

11. The composite damper of claim 8, wherein the dampening member has a loss modulus between 0.1 MPa and 1 GPa.

12. The composite damper of claim 1, wherein the dampening device has a plurality of rigid members, and the dampening member is received between the rigid members.

13. The composite damper of claim 12, wherein the dampening member has a viscoelasticity storage modulus between 1 MPa and 10 GPa.

14. The composite damper of claim 12, wherein the dampening member has a loss modulus between 0.1 MPa and 1 GPa.

15. The composite damper of claim 12, wherein the dampening member is rubber, macromolecular material, or metal alloys with high damping properties.

* * * * *